US009736569B2

(12) United States Patent
Kelly et al.

(10) Patent No.: US 9,736,569 B2
(45) Date of Patent: Aug. 15, 2017

(54) IN-EAR HEADPHONES WITH RETENTION MEMBERS

(71) Applicant: Skullcandy, Inc., Park City, UT (US)

(72) Inventors: Peter M. Kelly, Park City, UT (US); David George Vogt, Jr., Salt Lake City, UT (US); Andrew Pierce, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 15/130,178

(22) Filed: Apr. 15, 2016

(65) Prior Publication Data

US 2016/0309250 A1 Oct. 20, 2016

Related U.S. Application Data

(60) Provisional application No. 62/149,242, filed on Apr. 17, 2015.

(51) Int. Cl.
*H04R 25/00* (2006.01)
*H04R 1/10* (2006.01)

(52) U.S. Cl.
CPC ..... *H04R 1/105* (2013.01); *H04R 1/1016* (2013.01); *H04R 1/1066* (2013.01);
(Continued)

(58) Field of Classification Search
CPC .... H04R 1/1008; H04R 1/1016; H04R 1/105; H04R 1/1066; H04R 1/1075;
(Continued)

(56) References Cited

U.S. PATENT DOCUMENTS 2,939,923 A 6/1960 Henderson
3,080,011 A 3/1963 Henderson
(Continued)

FOREIGN PATENT DOCUMENTS

EP 806909 A1 11/1997
EP 1355508 A2 10/2003
(Continued)

OTHER PUBLICATIONS

US 8,712,088, 04/2014, Silvestri et al. (withdrawn)
(Continued)

*Primary Examiner* — Huyen D Le
(74) *Attorney, Agent, or Firm* — TraskBritt

(57) ABSTRACT

Retention members for an in-ear headphone include a base portion and a substantially straight flexible finger extending from the base portion. Absent external forces, the flexible finger includes a substantially straight longitudinal axis and a back surface extending from a proximal end portion to a distal end portion and having a plurality of recesses along a length of the back surface. The flexible finger is configured to, during use, bend into a curved shape for disposition under a user's antihelix. In-ear headphones include a shell defining a volume housing an audio driver, a nozzle extending from the shell configured for at least partial insertion into an ear canal, and a flexible retention member coupled to the shell, the flexible finger including a substantially straight longitudinal axis, a back surface, and a concave front surface.

24 Claims, 3 Drawing Sheets

(52) U.S. Cl.
CPC ..... *H04R 25/652* (2013.01); *H04R 2201/107* (2013.01); *H04R 2201/109* (2013.01); *H04R 2225/025* (2013.01)

(58) Field of Classification Search
CPC .... H04R 1/1091; H04R 25/60; H04R 25/652; H04R 25/658; H04R 2201/107; H04R 2201/109; H04R 2225/023; H04R 2225/025; A61F 11/08
USPC ..... 381/322, 323, 324, 328, 330, 370, 374, 381/380, 381, 382; 181/129, 130, 135; 379/420.02, 430
See application file for complete search history.

(56) References Cited

U.S. PATENT DOCUMENTS

| | | | | |
|---|---|---|---|---|
| 3,783,201 | A * | 1/1974 | Weiss | H04R 25/60 381/324 |
| 4,803,853 | A | 2/1989 | Hoerkens | |
| 5,048,090 | A * | 9/1991 | Geers | H04R 25/60 381/323 |
| 5,142,587 | A | 8/1992 | Kobayashi | |
| 5,659,156 | A | 8/1997 | Mauney et al. | |
| 5,712,453 | A | 1/1998 | Bungardt et al. | |
| 5,953,435 | A | 9/1999 | Mullin et al. | |
| 6,688,421 | B2 | 2/2004 | Dyer et al. | |
| 7,068,803 | B2 | 6/2006 | Kuhlmann et al. | |
| D529,901 | S | 10/2006 | Ohta | |
| 7,720,245 | B2 | 5/2010 | Bauman et al. | |
| D619,124 | S | 7/2010 | Clay | |
| 7,856,111 | B2 * | 12/2010 | Balke | H04R 25/652 381/322 |
| 7,899,200 | B2 | 3/2011 | Karamuk et al. | |
| D641,008 | S | 7/2011 | Lee et al. | |
| D641,737 | S | 7/2011 | Krauss et al. | |
| 7,986,803 | B1 | 7/2011 | Dekalb | |
| D644,212 | S | 8/2011 | Quek | |
| D644,213 | S | 8/2011 | Quek | |
| D645,457 | S | 9/2011 | Carr et al. | |
| 8,059,845 | B2 | 11/2011 | Bryant | |
| D653,244 | S | 1/2012 | Birger | |
| 8,116,501 | B2 | 2/2012 | Kusuda et al. | |
| 8,130,942 | B2 | 3/2012 | Howes et al. | |
| 8,175,315 | B2 | 5/2012 | Tanaka et al. | |
| 8,184,841 | B2 | 5/2012 | Wurfel | |
| 8,194,910 | B2 | 6/2012 | Uchida et al. | |
| D664,124 | S | 7/2012 | Smith et al. | |
| D668,632 | S | 10/2012 | Enquist | |
| D669,058 | S | 10/2012 | Lee et al. | |
| 8,331,593 | B2 | 12/2012 | Slemming et al. | |
| D679,267 | S | 4/2013 | Lee et al. | |
| D684,950 | S | 6/2013 | Schaal et al. | |
| D684,953 | S | 6/2013 | Schaal et al. | |
| D686,191 | S | 7/2013 | Schaal et al. | |
| D687,021 | S | 7/2013 | Yuen | |
| D689,848 | S | 9/2013 | Lee et al. | |
| 8,526,600 | B2 | 9/2013 | Howes et al. | |
| D693,326 | S | 11/2013 | Takeno | |
| D694,220 | S | 11/2013 | Lee et al. | |
| D695,264 | S | 12/2013 | Chee | |
| D695,265 | S | 12/2013 | Schaal et al. | |
| D695,266 | S | 12/2013 | Schaal et al. | |
| D695,267 | S | 12/2013 | Schaal et al. | |
| D695,276 | S | 12/2013 | Chee | |
| D695,720 | S | 12/2013 | Chee | |
| 8,600,096 | B2 | 12/2013 | Lin | |
| D697,049 | S | 1/2014 | Krauss et al. | |
| 8,666,102 | B2 | 3/2014 | Bruckhoff et al. | |
| 8,688,036 | B2 | 4/2014 | Parkins et al. | |
| 8,792,663 | B2 | 7/2014 | Cano et al. | |
| 2003/0196850 | A1 | 10/2003 | Dyer et al. | |
| 2006/0067556 | A1 | 3/2006 | Bailey et al. | |
| 2008/0037817 | A1 | 2/2008 | Ewert et al. | |
| 2008/0205679 | A1 | 8/2008 | Darbut et al. | |
| 2009/0041284 | A1 | 2/2009 | Tanaka et al. | |
| 2009/0041287 | A1 | 2/2009 | Quinlisk | |
| 2009/0296975 | A1 | 12/2009 | Uchida et al. | |
| 2010/0098285 | A1 | 4/2010 | Kusuda et al. | |
| 2010/0320961 | A1 | 12/2010 | Castillo et al. | |
| 2011/0002498 | A1 | 1/2011 | Wong et al. | |
| 2011/0255729 | A1 | 10/2011 | Tan et al. | |
| 2012/0039501 | A1 | 2/2012 | Silvestri et al. | |
| 2012/0057739 | A1 | 3/2012 | Smith et al. | |
| 2012/0189154 | A1 | 7/2012 | Howes et al. | |
| 2013/0058517 | A1 | 3/2013 | Lee et al. | |
| 2013/0136294 | A1 | 5/2013 | Lee et al. | |
| 2013/0148838 | A1 | 6/2013 | Silvestri et al. | |
| 2013/0177193 | A1 | 7/2013 | Orzel et al. | |
| 2013/0315410 | A1 | 11/2013 | Annunziato et al. | |
| 2014/0211977 | A1 | 7/2014 | Armstrong | |
| 2014/0307911 | A1 | 10/2014 | Inoda | |

FOREIGN PATENT DOCUMENTS

| | | | |
|---|---|---|---|
| EP | 1377113 | A2 | 1/2004 |
| EP | 806909 | A4 | 2/2006 |
| EP | 1364553 | B1 | 9/2006 |
| EP | 1355508 | A3 | 11/2007 |
| EP | 2071867 | A1 | 6/2009 |
| EP | 1652366 | B1 | 2/2010 |
| EP | 2259556 | A1 | 12/2010 |
| EP | 2259556 | B1 | 6/2012 |
| EP | 2552126 | A2 | 1/2013 |
| EP | 2566187 | A2 | 3/2013 |
| EP | 2566188 | A2 | 3/2013 |
| EP | 2566188 | A3 | 3/2013 |
| EP | 2645736 | A1 | 10/2013 |
| WO | 9530320 | A1 | 11/1995 |
| WO | 9623443 | A1 | 8/1996 |
| WO | 03098965 | A1 | 11/2003 |
| WO | 2013019829 | A1 | 2/2013 |
| WO | 2013177282 | A1 | 11/2013 |
| WO | 2014017922 | A1 | 1/2014 |
| WO | 2014051416 | A1 | 4/2014 |

OTHER PUBLICATIONS

Jabra, Jabra Sport PulseTM Wireless, Technical Specifications, https://www.estore.com.au/content/productbrochures/jab000055_0.pdf, created Sep. 3, 3014, 1 page.

European Search Report for European Application No. 16164251 dated Jul. 5, 2016, 5 pages.

* cited by examiner

IN-EAR HEADPHONES WITH RETENTION MEMBERS

CROSS-REFERENCE TO RELATED APPLICATION

This application claims the benefit of U.S. Provisional Patent Application Ser. No. 62/149,242, filed Apr. 17, 2015, the disclosure of which is hereby incorporated herein in its entirety by this reference.

FIELD

Embodiments of the present disclosure relate to an in-ear headphone having a retention member for securing the in-ear headphone in the ear.

BACKGROUND

In recent years, in-ear headphones (also known in the industry as "earbuds") have gained popularity. This increase in popularity may be partly due to the generally smaller, lighter, and less obtrusive geometry offered by in-ear headphones compared to on-ear and over-ear headphones. Also, some people may prefer the sound generated by in-ear headphones compared to other types of headphones.

Although in-ear headphones offer advantages over other types of headphones, there are also some disadvantages associated with in-ear headphones. Among these disadvantages is the difficulty of designing in-ear headphones that are securely retained in the ears of most or all people. The size and shape of each different person's ear is unique. In fact, the size and shape of one of a person's ears may be different from the size and/or shape of that same person's other ear. Accordingly, retention members for in-ear headphones have been developed for engaging with portions of the outer ear to hold the in-ear headphones in place in or over the ear canal. However, due to the unique shape and size of outer ears of different users, many known retention members having a single size and design are not adequately retained in the ears of many users.

SUMMARY

In some embodiments, this disclosure includes retention members for an in-ear headphone that include a base portion configured for coupling to an audio driver housing and a substantially straight flexible finger extending from the base portion. Absent external forces, the flexible finger includes a substantially straight longitudinal axis, a back surface extending from a proximal end portion of the flexible finger proximate to the base portion to a distal end portion of the flexible finger distant from the base portion, and a plurality of recesses along a length of the back surface. The flexible finger is configured to, during use, bend into a curved shape for disposition under a user's antihelix, such that portions of the back surface between the plurality of recesses abut against the user's antihelix and the distal end portion is positioned between the user's antihelix and crux of helix.

In some embodiments, this disclosure includes in-ear headphones that include a shell, a nozzle extending from the shell, and a flexible retention member coupled to the shell. The shell defines a volume housing an audio driver, and is shaped and sized to fit at least partially within a lower concha of a user's ear. The nozzle defines a sound channel extending axially therethrough, the nozzle configured for insertion at least partially into the ear canal of the user. The flexible retention member includes a base portion sized and configured for coupling to the shell, and a flexible finger extending from the base portion from a proximal end portion to a distal end portion. The flexible finger includes, when not installed in the ear of a user and absent external forces, a substantially straight longitudinal axis, a back surface extending from the proximal end portion to the distal end portion, and a concave front surface opposite the back surface, the front surface extending from the proximal end portion to the distal end portion.

DETAILED DESCRIPTION

Figure 1:
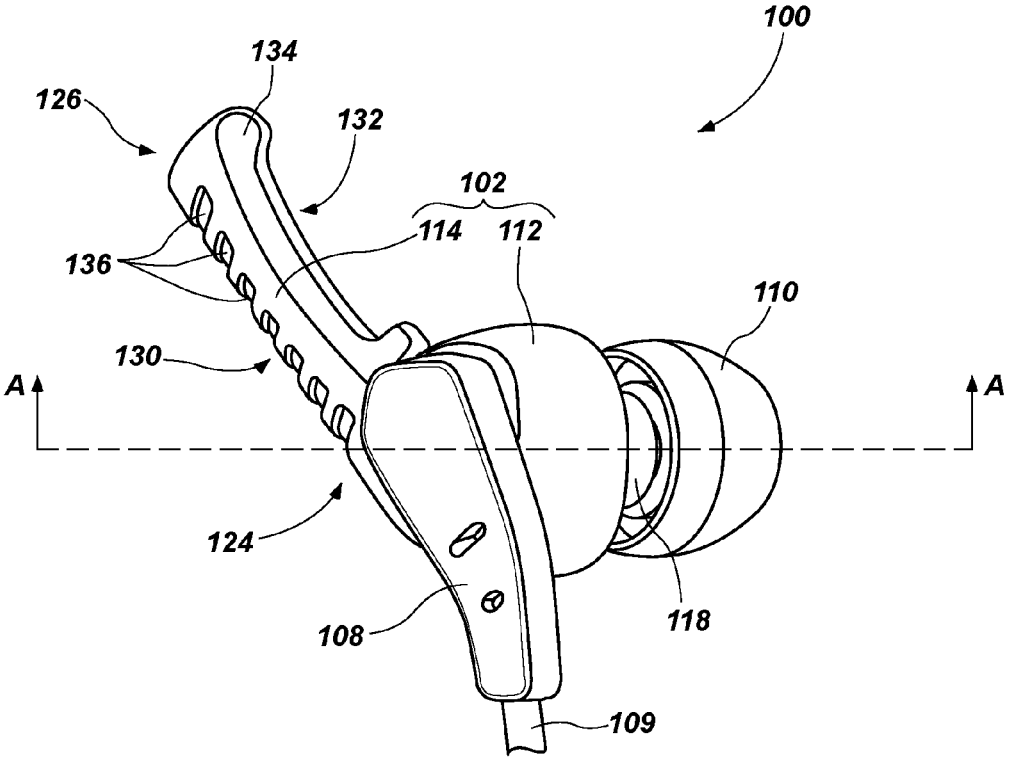
FIG. 1 shows a perspective view of an embodiment of an in-ear headphone according to the present disclosure.

The following description provides specific details, such as material types, sizes, configurations, and conditions in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional fabrication techniques and materials employed in the industry.

In the following detailed description, reference is made to the accompanying drawings, which form a part hereof, and in which is shown, by way of illustration, specific embodiments in which the present disclosure may be practiced. These embodiments are described in sufficient detail to enable a person of ordinary skill in the art to practice the present disclosure. However, other embodiments may be utilized, and changes may be made without departing from the scope of the disclosure. The illustrations presented herein are not meant to be actual views of any particular system, device, structure, or process, but are idealized representations which are employed to describe the embodiments of the present disclosure. The drawings presented herein are not necessarily drawn to scale. Similar structures or components in the various drawings may retain the same or similar numbering for the convenience of the reader; however, the similarity in numbering does not mean that the structures or components are necessarily identical in size, composition, configuration, or other property.

As used herein, the term "substantially" in reference to a given parameter, property, at condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational term, such as "first," "second," etc., is used for clarity and convenience in understanding the disclosure and accompanying drawings and does not connote or depend on any specific preference, orientation, or order, except where the context clearly indicates otherwise.

As used herein, any directional term, such as "front," "back," "left," "right," "vertical," "horizontal," etc., refers to a direction from the perspective of a user of the in-ear headphone(s) described herein. Such directional terms are used to describe features of the in-ear headphone(s) when the in-ear headphone(s) is positioned in an initial orientation prior to and for insertion and use in an ear of the user. Unless indicated otherwise, the directional terms are also referred to herein absent any external forces that may deform (e.g., bend) any portion (e.g., a retention member) of the in-ear headphone(s).

The embodiments of the present disclosure include retention members for in-ear headphones and in-ear headphones including such retention members. The retention members include a substantially straight flexible finger configured for positioning under an antihelix of a user's ear, to securely hold the in-ear headphone in the user's ear. The flexible finger may be deformed (e.g., bent) for positioning under the antihelix. The flexible finger includes a substantially straight longitudinal axis, absent external forces. The flexible finger includes a back surface, which may be substantially straight in some embodiments. The flexible finger may include at least one recess in the back surface. In some embodiments, the flexible finger may include a concave front surface on an opposite side of the flexible finger from the back surface.

Figure 2:
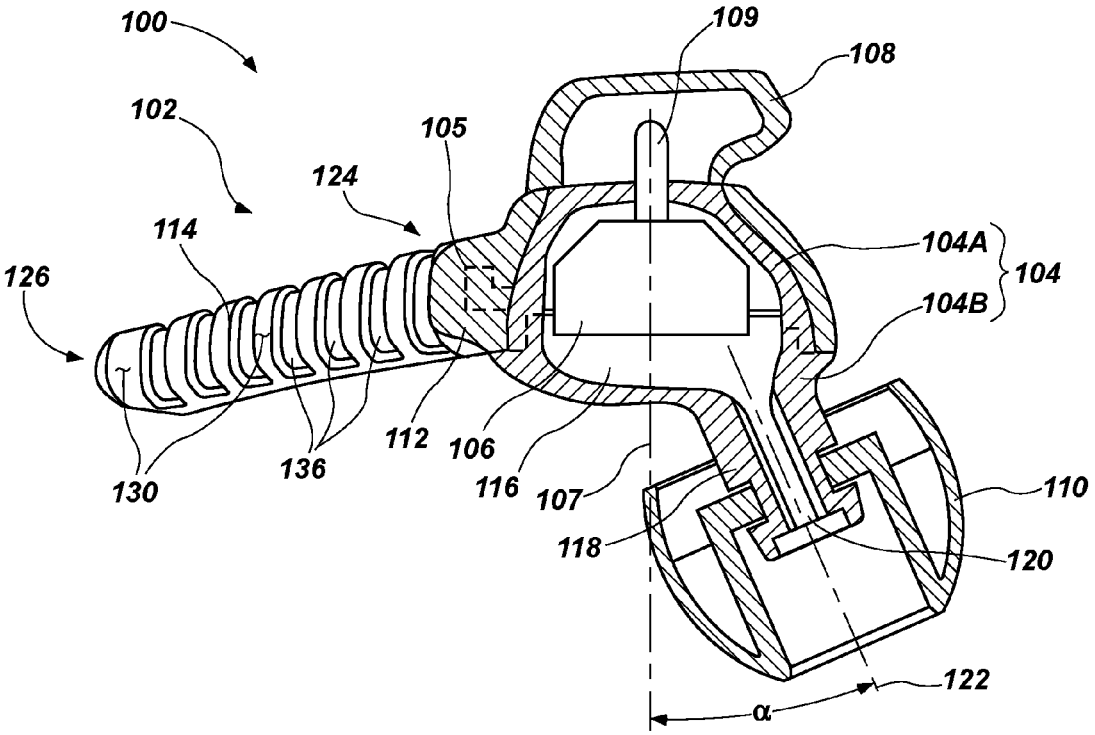
FIG. 2 shows a cross-sectional view of the in-ear headphone of FIG. 1 taken from line A-A of FIG. 1.

Referring to FIGS. 1 and 2, an in-ear headphone 100 includes a retention member 102, a shell 104 for housing an audio driver 106, an interface 108, and an eargel 110 coupled to a nozzle 118. The in-ear headphone 100 shown in the accompanying drawings is configured for use with a user's right ear. An in-ear headphone according to the present disclosure that is configured for use with the user's left ear is substantially the same as the in-ear headphone 100 shown in the accompanying drawings and described herein, but is substantially a mirror image of the in-ear headphone 100 shown in the accompanying drawings.

As shown in FIG. 2, the shell 104 may define an inner volume 116 for housing the audio driver 106. The shell 104 may be a single, integral unit or the shell 104 may include a first shell portion 104A and a second shell portion 104B coupled to the first shell portion 104A. Optionally, the shell 104 may include an engagement structure 105 (shown in dashed lines in FIG. 2) on an exterior surface thereof for engaging with a complementary recess in the retention member 102, to couple and position the retention member 102 to the shell 104. As is known in the art, the audio driver 106 within the shell 104 may include a diaphragm that vibrates back and forth to generate sound during use. A central axis 107 of the audio driver 106 may be defined as an axis along which the diaphragm moves as it vibrates during sound generation and that is located at a center of the diaphragm of the audio driver 106.

As is shown in FIGS. 1 and 2, the interface 108 may house a portion of an electrical cord 109 extending from the shell 104. The electrical cord 109 may be for providing a signal to the audio driver 106, which may be converted to sound by the audio driver 106 during use. As is known in the art, the electrical cord 109 may be configured for operable connection of the audio driver 106 to an electronic device, such as a cellular phone, a tablet, an MP3 player, or an auxiliary outlet of a speaker, personal computer, or automobile audio system. In some embodiments, the cord 109 may be omitted and the interface 108 may house one or more wireless communication devices for communication with an electronic device, such as by using radio, Wi-Fi, BLUETOOTH®, or cellular signals. The interface 108 may house a microphone.

The nozzle 118 may extend from the shell 104 and may define a sound channel 120 extending axially therethrough. The nozzle 118 may be an integral portion of the shell 104 (e.g., a portion of the second shell portion 104B), or the nozzle 118 may be a separate part that is coupled to the shell 104, such as by an adhesive or by mechanical interference. The nozzle 118 may be sized and configured for insertion into an ear canal of the user. A nozzle axis 122 may be defined axially through the sound channel 120 of the nozzle 118. To complement the structure of human ear shapes, the nozzle 118 may be tilted relative to the shell 104 and audio driver 106, such that the nozzle axis 122 is at an angle $\alpha$ from the central axis 107 of the audio driver 106, in a direction toward a front of the user when the in-ear headphone 100 is installed in the user's ear. By way of example and not limitation, the angle $\alpha$ between the nozzle axis 122 and the central axis 107 of the audio driver 106 may be between about 18° and about 30°. The eargel 110 may be a flexible member that is coupled to (e.g., at least partially laterally surrounding) the nozzle 118 to comfortably retain the nozzle 118 within the user's ear canal and, optionally, to substantially seal the ear canal to attenuate external sounds and to provide a secure fit.

The retention member 102 may include a base portion 112 coupled to the shell 104 and a flexible finger 114 extending from the base portion 112 in a substantially straight direction. The retention member 102 may be fixedly coupled to the shell 104, such as by an adhesive, mechanical interference, or integral molding, or the retention member 102 may be removably coupled to the shell 104 for replacement or cleaning, for example.

In embodiments in which the retention member 102 is integrally molded with the shell 104, the shell 104 (or a portion thereof, such as the first shell portion 104A) may be formed of a rigid material and placed in an overmold having an internal shape complementary to an external shape of the retention member 102. A heated flexible material for the retention member 102 may then be flowed into the overmold and around the shell 104 (or the portion thereof, such as the first shell portion 104A) and allowed to cool and harden. Subsequently, other components of the in-ear headphone 100, such as the second portion 104B of the shell 104, the audio driver 106, the interface 108, and the eargel 110 may be coupled to the shell 104 and/or the first shell portion 104A to complete assembly of the in-ear headphone 100.

The base portion 112 of the retention member 102 may at least partially surround the shell 104. The base portion 112 and the shell 104 together may be shaped and sized for disposal at least partially within a concha of the user's outer ear. For example, the base portion 112 may have a curved outer surface for a comfortable fit. At least the flexible finger 114 of the retention member 102 may include a flexible (e.g., elastic) material that is sized and configured for deforming (e.g., bending) to provide pressure against the antihelix of the user's outer ear, as will be explained below with reference to FIGS. 6 and 7. In some embodiments, the flexible material selected for the flexible finger 114 and/or base portion 112 may have a hardness of between about 30 Shore A and about 80 Shore A, such as between about 30 Shore A and 50 Shore A. By way of example and not limitation, the flexible finger 114 and/or base portion 112 may include a silicone rubber material, a natural rubber material, a styrene butadiene rubber material, a polymer foam material, a nitrile material, or a latex material.

The flexible finger 114 of the retention member 102 includes a proximal end portion 124 proximate to the base portion 112 and a distal end portion 126 distant from the base portion 112. A back surface 130 of the flexible finger 114 may extend along a length of the flexible finger 114 from the proximal end portion 124 to the distal end portion 126. A front surface 132 on a side of the flexible finger 114 opposite the back surface 130 may also extend along a length of the flexible finger 114 from the proximal end portion 124 to the distal end portion 126.

In some embodiments, the back surface 130 may, in an initial, non-deformed position (i.e., absent external forces), be substantially straight from the proximal end portion 124 to the distal end portion 126. The initial substantial straightness of the back surface 130 may enable the retention member 102 to be bent for use with a variety of different ear shapes and sizes, while maintaining pressure against the antihelix for a secure fit regardless of the particular ear shape and size. In some embodiments, the back surface 130 of the flexible finger 114 may extend from the base portion 112 substantially tangentially to the curve of the base portion 112. A length of the substantially straight back surface 130, absent external forces, may be sufficient to position the distal end portion 126 between the antihelix and the helix of a majority of adult human ears when in use. By way of example and not limitation, the length of the substantially straight back surface 130 may be between about 0.75 inch and about 1.5 inch, such as about between about 1.0 inch and about 1.25 inch.

The present disclosure also includes sets of retention members 102 of different sizes, to enable a particular user to select and use a retention member 102 that best fits the ear of the particular user. By way of example and not limitation, a set of retention members 102 may include a plurality of retention members 102 including back surfaces 130 of flexible fingers 114 having initial (i.e., absent external forces) respective lengths of about 0.9 inch, about 1.0 inch, about 1.1 inches, and/or about 1.2 inches.

In some embodiments, a protrusion 134 (FIG. 1) may extend from the front surface 132 of the flexible finger 114 at the distal end portion 126 in a direction defined from the back surface 130 to the front surface 132. The protrusion 134 may be provided for an improved fit of the flexible finger 114 between the antihelix and a helix of the user's outer ear and for retaining the flexible finger 114 in place under the antihelix, as will be explained below with reference to FIGS. 6 and 7.

In some embodiments, the back surface 130 may include one or more recesses 136 along a length of the flexible finger 114. By way of example and not limitation, as shown in FIGS. 1 and 2, there may be seven recesses 136 along the length of the flexible finger 114, although any quantity of recesses 136 may be provided to tailor the flexibility and, conversely, rigidity of the flexible finger 114. The one or more recesses 136 may be provided in the back surface 130 to facilitate bending of the flexible finger 114 from the back surface 130 toward the front surface 132 by reducing tension along the back surface 130.

In some embodiments, the front surface 132 may be generally concave when the flexible finger 114 is in an initial, non-deformed position (i.e., absent external forces). The concavity of the front surface 132 may facilitate bending of the flexible finger 114 from the back surface 130 toward the front surface 132 by reducing compression along the front surface 132. The concave front surface 132 may also improve comfort of the flexible finger 114 within the user's outer ear by providing clearance for features of the outer ear (e.g., the helix).

Figure 3:
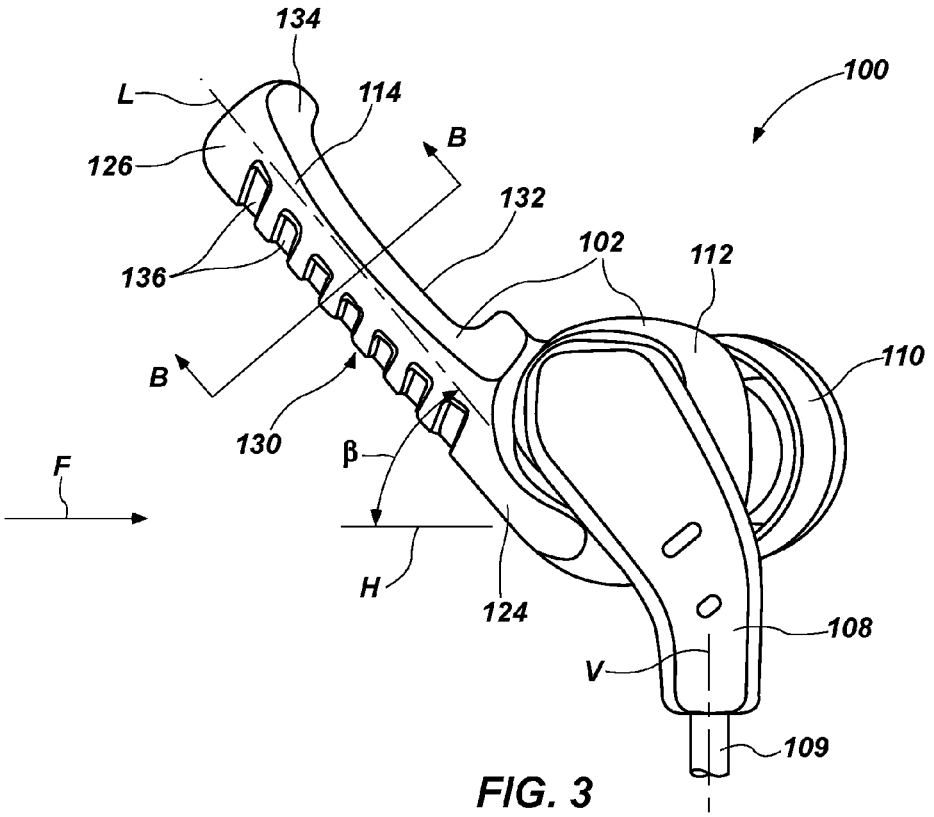
FIG. 3 shows a side view of the in-ear headphone of FIG. 1.

FIG. 3 illustrates a side view of the in-ear headphone 100 in an initial position and orientation for, but prior to, insertion into the ear of the user. In the view of FIG. 3, the flexible finger 114 of the in-ear headphone 100 for the right ear may extend to the left and upward from the base portion 112 (e.g., up and back relative to the user, who would be facing to the right in the view of FIG. 3, as shown by arrow F). A vertical reference axis V may be defined as an axis through which the cord 109 extends from the in-ear headphone 100 (e.g., in the downward direction from the perspective of FIG. 3). A horizontal reference axis H may be defined as perpendicular to the vertical reference axis V. A longitudinal axis L of the flexible finger 114 may extend from the proximal end portion 124 to the distal end portion 126 at an angle β from the horizontal reference axis H. By way of example and not limitation, the angle β between the horizontal reference axis H and the longitudinal axis L, in an initial position (i.e., absent external forces), may be between about 30° and about 60°, such as about 50°.

Figure 4:
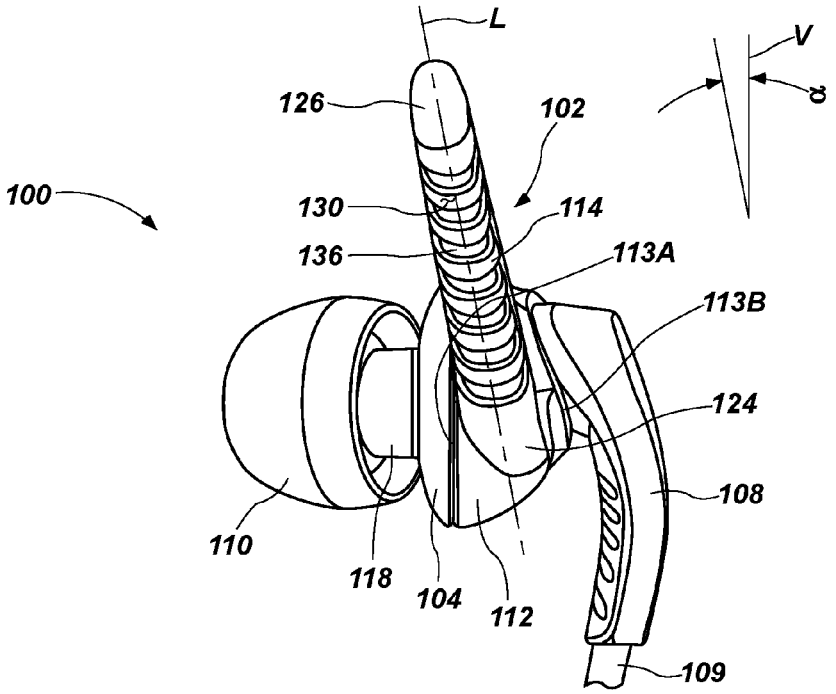
FIG. 4 shows a back view of the in-ear headphone of FIG. 1.

FIG. 4 illustrates a back view (i.e., from the perspective of the direction shown by the arrow F in FIG. 3) of the in-ear headphone 100 in the initial position and orientation for, but prior to, insertion into the ear of the user. In the view of FIG. 4, the flexible finger 114 of the in-ear headphone 100 for the right ear may extend to the left and upward from the base portion 112 (e.g., up and to the left, i.e., toward the head, relative to the user who would be facing into the page in the view of FIG. 4). Thus, the longitudinal axis L of the flexible finger 114 may initially extend from the proximal end portion 124 to the distal end portion 126 at an angle γ from the vertical reference axis V, toward a side of the shell 104 from which the nozzle 118 extends. By way of example and not limitation, the angle γ between the vertical reference axis V and the flexible finger 114, in an initial position (i.e., absent external forces and in an orientation for, but prior to, insertion into the ear of the user), may be between about 5° and about 15°, such as about 10°. The angle γ of the flexible finger 114 toward the user's head during use may be complementary to the actual geometry of features of the user's ear and may provide pressure in a direction that tends to securely hold the in-ear headphone 100 in place during use.

As shown in FIG. 4, the flexible finger 114 may have a greater width at the proximal end portion 124 than at the distal end portion 126, such that the flexible finger 114 may generally taper along its length. The angle of taper (e.g., an angle between opposing substantially linear side surfaces) of the flexible finger 114 may be between about 1° and about 5°.

The base portion 112 of the retention member 102 may include a first opening 113A on a first side of the base portion 112 and a second opening 113B on a second, opposite side of the base portion 112. In embodiments in which the retention member 102 is removable from the shell 104 or simply adhered to the shell 104, during the process of positioning and coupling the retention member 102 to the shell 104, the base portion 112 may be enlarged (e.g., stretched) to fit at least a portion of the shell 104 through at least one of the first opening 113A and the second opening 113B. The nozzle 118 may be positioned to extend through or from the first opening 113A. The interface 108 may be positioned to extend through or from the second opening 113B. In embodiments in which the retention member 102 is integrally formed with the shell 104, such as with the first shell portion 104A, the first and second openings 113A and 113B may be provided for coupling other components of the in-ear headphone 100 thereto.

Figure 5:
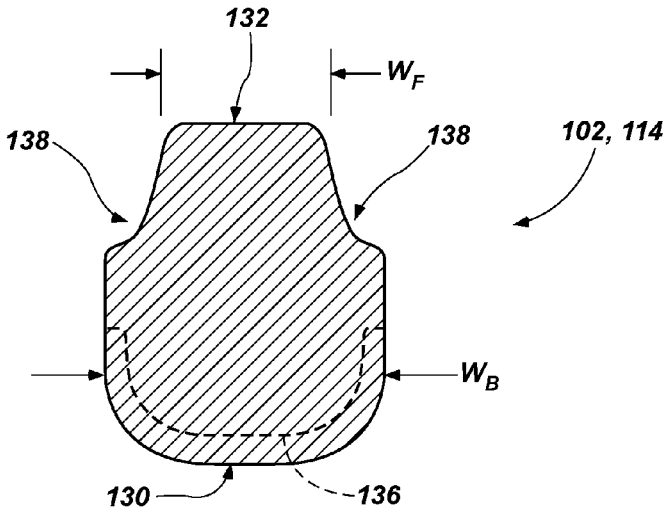
FIG. 5 shows a cross-sectional view of a flexible finger of the in-ear headphone of FIG. 1, taken from line B-B of FIG. 3.

FIG. 5 illustrates a cross-sectional view of the flexible finger 114 taken from line B-B in FIG. 3. As shown in FIG. 5, a first width $W_B$ of the flexible finger 114 proximate the back surface 130 may be greater than a second width $W_F$ of the flexible finger 114 proximate the front surface 132. The second width $W_F$ proximate the front surface 132 may be reduced to facilitate bending of the flexible finger 114 by providing less material to compress, and to provide a comfortable fit in the user's ear. In some embodiments, elongated recesses 138 may extend along lateral sides of the front surface 132 to reduce the second width $W_F$ proximate the front surface 132 compared to the first width $W_B$ proximate the back surface 130.

Figure 6:
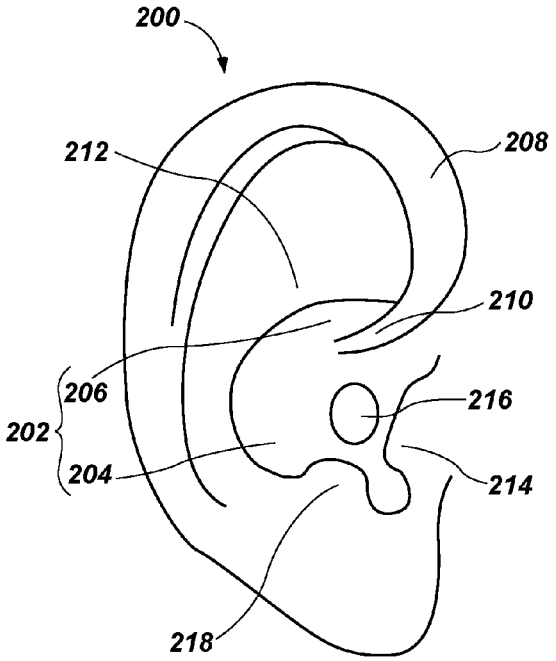
FIG. 6 shows a schematic diagram of an outer ear of a user.
Figure 7:
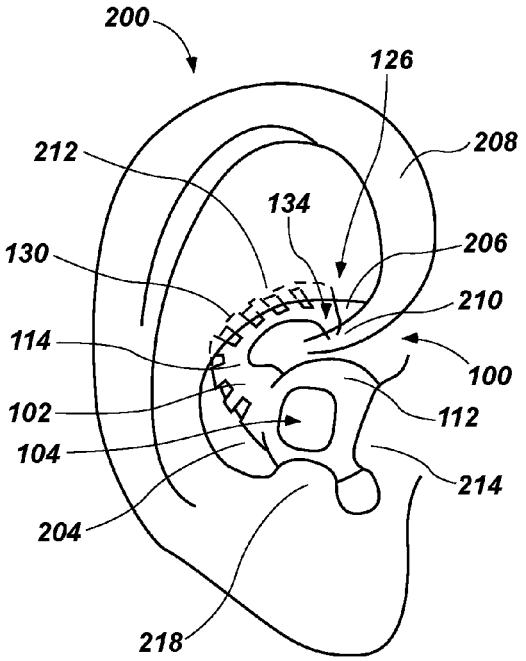
FIG. 7 shows a schematic diagram of the outer ear of the user of FIG. 6, with an embodiment of an in-ear headphone according to the present disclosure installed in the outer ear for use.

Referring to FIGS. 5 and 6, installation and use of the in-ear headphone 100 in a user's ear 200 will be described. A schematic depiction of the user's ear 200 is shown in FIG. 5 to describe the anatomy thereof. The user's ear 200 includes a concha 202, including a lower concha 204 and an upper concha 206. A helix 208 extends along an outer periphery of the user's ear 200, and terminates in the concha 200 at a crux 210 of the helix 208. An antihelix 212 extends around the concha 202 from the lower concha 204, around and above the upper concha 206, and terminates under or proximate the helix 208. A tragus 214 is a flap at the front of the ear and protrudes over the lower concha 204 in front of an ear canal 216. An antitragus 218 is a protrusion at a location across the lower concha 204 from the tragus 214 and at a lower end of the lower concha 204. The lower concha 204 is defined outside of the ear canal 216, between the tragus 214, antitragus 218, and antihelix 212, and below the crux 210 of the helix 208. The upper concha 206 is defined between an upper portion of the antihelix 212 and the crux 210 of the helix 208.

FIG. 6 illustrates the in-ear headphone 100, with the interface 108 and cord 109 removed for clarity, installed in the user's ear 200. The nozzle 118 and eargel 110 (not visible in the view of FIG. 6) are positioned at least partially within the ear canal 216 (not visible in the view of FIG. 6). The shell 104 and the base portion 112 of the retention member 102 are positioned at least partially within the lower concha 204. Depending on the particular shape and size of the features of the user's ear 200, the shell 104 and the base portion 112 may be positioned partially under the tragus 214 and/or antitragus 218. The flexible finger 114 of the retention member 102 may be bent forward and positioned along and partially under the antihelix 212, such that at least a portion of the back surface 130 abuts against the antihelix 212. The distal end portion 126 of the flexible finger 114 may be positioned in the upper concha 206. In some embodiments and depending on the shape and size of the features of the user's ear 200, the protrusion 134 at the distal end 126 may be positioned under the crux 210 of the helix 208. In such a case, the protrusion 134 may inhibit the distal end portion 126 from inadvertently flexing outward and even becoming dislodged from the upper concha 206.

Accordingly, when the in-ear headphone 100 is positioned for use within the user's ear 200, as illustrated in FIG. 6, the flexible finger 114 may press back and up against the antihelix 212 to urge the base portion 112 and shell 104 forward and down into a secure position within the lower concha 204 of the user's ear 200. The positioning of the flexible finger 114 under and against the antihelix 212 may further hold the in-ear headphone 100 securely against the concha to inhibit the in-ear headphone 100 from falling out of the user's ear 200, such as due to the user's head movement. Thus, the in-ear headphone 100 of the present disclosure may remain securely in place in the user's ear 200 even when the user moves, such as when walking, dancing, jogging, running, exercising, or performing other activities. In addition, the structure, size, material, and form of the in-ear headphone 100 of the present disclosure may provide a universal fit that may be used for a variety of ear sizes and shapes.

Additional non-limiting example embodiments of the present disclosure are set forth below.

Embodiment 1

A retention member for an in-ear headphone, comprising: a base portion configured for coupling to an audio driver housing; a substantially straight flexible finger extending from the base portion, the flexible finger comprising, absent external forces: a substantially straight longitudinal axis; a back surface extending from a proximal end portion of the flexible finger proximate to the base portion to a distal end portion of the flexible finger distant from the base portion; and a plurality of recesses along a length of the back surface; wherein the flexible finger is configured to, during use, bend into a curved shape for disposition under a user's antihelix, such that portions of the back surface between the plurality of recesses abut against the user's antihelix and the distal end portion is positioned between the user's antihelix and crux of helix.

Embodiment 2

The retention member of Embodiment 1, wherein an outer surface of the base portion is curved and wherein the back surface of the flexible finger is substantially tangential to the curve of the outer surface of the base portion.

Embodiment 3

The retention member of any one of Embodiments 1 and 2, wherein the base portion and the flexible finger comprise a single, integral structure.

Embodiment 4

The retention member of any one of Embodiments 1 through 3, wherein a first width of the flexible finger proximate the back surface is greater than a second width of the flexible finger proximate the front surface.

Embodiment 5

The retention member of any one of Embodiments 1 through 4, wherein the flexible finger comprises a material exhibiting a hardness of between about 30 Shore A and about 80 Shore A.

Embodiment 6

The retention member of any one of Embodiments 1 through 5, wherein the flexible finger comprises a silicone material.

Embodiment 7

The retention member of any one of Embodiments 1 through 6, wherein the flexible finger comprises a protrusion at the distal end thereof, the protrusion extending from the front surface in a direction defined from the back surface to the front surface.

Embodiment 8

The retention member of any one of Embodiments 1 through 7, wherein the flexible finger further comprises a front surface on an opposite side of the flexible finger from the back surface, the front surface having, absent external forces, a concave shape.

Embodiment 9

An in-ear headphone, comprising: a shell defining a volume housing an audio driver, the shell shaped and sized to fit at least partially within a lower concha of a user's ear; a nozzle extending from the shell and defining a sound channel extending axially therethrough, the nozzle configured for insertion at least partially into the ear canal of the user; and a flexible retention member coupled to the shell, the flexible retention member comprising: a base portion sized and configured for coupling to the shell; and a flexible finger extending from the base portion from a proximal end portion to a distal end portion, the flexible finger comprising, when not installed in the ear of a user and absent external forces, a substantially straight longitudinal axis, a back surface extending from the proximal end portion to the distal end portion, and a concave front surface opposite the back surface, the front surface extending from the proximal end portion to the distal end portion.

Embodiment 10

The in-ear headphone of Embodiment 9, further comprising an eargel coupled to the nozzle.

Embodiment 11

The in-ear headphone of any one of Embodiments 9 and 10, wherein the shell comprises an engagement structure protruding therefrom and the base portion of the flexible retention member comprises a recess complementary to the engagement structure for coupling the flexible retention member to the shell.

Embodiment 12

The in-ear headphone of any one of Embodiments 9 through 11, wherein the base portion comprises a first opening into the cavity of the base portion and a second, opposite opening into the base portion.

Embodiment 13

The in-ear headphone of any one of Embodiments 9 through 12, wherein the back surface comprises one or more recesses therein.

Embodiment 14

The in-ear headphone of any one of Embodiments 9 through 13, wherein the flexible retention member is removable from the shell.

Embodiment 15

The in-ear headphone of any one of Embodiments 9 through 13, wherein the flexible retention member is integrally molded with at least a portion of the shell.

Embodiment 16

The in-ear headphone of any one of Embodiments 9 through 15, wherein the flexible finger extends from the proximal end portion to the distal end portion in a direction toward a side of the shell from which the nozzle extends.

Embodiment 17

The in-ear headphone of Embodiment 16, wherein the flexible finger extends in the direction toward the side of the shell from which the nozzle extends at an angle of between about 1° and about 5° from a vertical direction, when the in-ear headphone is in an initial position for insertion into the user's ear Embodiment 18

The in-ear headphone of any one of Embodiments 9 through 17, wherein the flexible finger extends from the proximal end portion to the distal end portion at an angle configured to be up and back relative to the user when the in-ear headphone is oriented for insertion into the user's ear.

Embodiment 19

The in-ear headphone of any one of Embodiments 9 through 18, wherein the flexible finger has a length sufficient to position the distal end portion of the flexible finger in an upper concha of the user's ear between a helix and an antihelix of the user's ear during use.

Embodiment 20

The in-ear headphone of any one of Embodiments 9 through 19, wherein the sound channel of the nozzle defines a nozzle axis, the nozzle axis being at an angle to a central axis of the audio driver.

Embodiment 21

The in-ear headphone of Embodiment 20, wherein the angle between the nozzle axis and the central axis of the audio driver is between about 18° and about 30°.

Embodiment 22

The in-ear headphone of any one of Embodiments 9 through 21, further comprising an electrical cord extending from the shell for operable connection of the audio driver to an electronic device.

Embodiment 23

The in-ear headphone of any one of Embodiments 9 through 22, wherein the shell comprises a first shell portion and a second shell portion coupled to the first shell portion.

Embodiment 24

The in-ear headphone of Embodiment 23, wherein the second shell portion comprises the nozzle.

The embodiments of the disclosure described above and illustrated in the accompanying drawing figures do not limit the scope of the invention, since these embodiments are merely examples of embodiments of the disclosure. The invention is encompassed by the appended claims and their legal equivalents. Any equivalent embodiments lie within the scope of this disclosure. Indeed, various modifications of the present disclosure, in addition to those shown and described herein, such as other combinations and modifications of the elements described, will become apparent to those of ordinary skill in the art from the description. Such embodiments, combinations, and modifications also fall within the scope of the appended claims and their legal equivalents.

What is claimed is:

1. A retention member for an in-ear headphone, comprising:

a base portion configured for coupling to an audio driver housing;

a substantially straight flexible finger extending from the base portion, the flexible finger comprising, absent external forces:

a substantially straight longitudinal axis;

a back surface extending from a proximal end portion of the flexible finger proximate to the base portion to a distal end portion of the flexible finger distant from the base portion; and a plurality of recesses along a length of the back surface;

wherein the flexible finger is configured to, during use, bend into a curved shape for disposition under a user's antihelix, such that portions of the back surface between the plurality of recesses abut against the user's antihelix and the distal end portion is positioned between the user's antihelix and crux of helix.

2. The retention member of claim 1, wherein an outer surface of the base portion is curved and wherein the back surface of the flexible finger is substantially tangential to the curve of the outer surface of the base portion.

3. The retention member of claim 1, wherein the base portion and the flexible finger comprise a single, integral structure.

4. The retention member of claim 1, wherein a first width of the flexible finger proximate the back surface is greater than a second width of the flexible finger proximate the front surface.

5. The retention member of claim 1, wherein the flexible finger comprises a material exhibiting a hardness of between about 30 Shore A and about 80 Shore A.

6. The retention member of claim 1, wherein the flexible finger comprises a silicone material.

7. The retention member of claim 1, wherein the flexible finger comprises a protrusion at the distal end thereof, the protrusion extending from the front surface in a direction defined from the back surface to the front surface.

8. The retention member of claim 1, wherein the flexible finger further comprises a front surface on an opposite side of the flexible finger from the back surface, the front surface having, absent external forces, a concave shape.

9. An in-ear headphone, comprising:

a shell defining a volume housing an audio driver, the shell shaped and sized to fit at least partially within a lower concha of a user's ear;

a nozzle extending from the shell and defining a sound channel extending axially therethrough, the nozzle configured for insertion at least partially into the ear canal of the user; and a flexible retention member coupled to the shell, the flexible retention member comprising:

a base portion sized and configured for coupling to the shell; and a flexible finger extending from the base portion from a proximal end portion to a distal end portion, the flexible finger comprising, when not installed in the ear of a user and absent external forces, a substantially straight longitudinal axis, a back surface extending from the proximal end portion to the distal end portion, and a concave front surface opposite the back surface, the front surface extending from the proximal end portion to the distal end portion.

10. The in-ear headphone of claim 9, further comprising an eargel coupled to the nozzle.

11. The in-ear headphone of claim 9, wherein the shell comprises an engagement structure protruding therefrom and the base portion of the flexible retention member comprises a recess complementary to the engagement structure for coupling the flexible retention member to the shell.

12. The in-ear headphone of claim 9, wherein the base portion comprises a first opening into the cavity of the base portion and a second, opposite opening into the base portion.

13. The in-ear headphone of claim 9, wherein the back surface comprises one or more recesses therein.

14. The in-ear headphone of claim 9, wherein the flexible retention member is removable from the shell.

15. The in-ear headphone of claim 9, wherein the flexible retention member is integrally molded with at least a portion of the shell.

16. The in-ear headphone of claim 9, wherein the flexible finger extends from the proximal end portion to the distal end portion in a direction toward a side of the shell from which the nozzle extends.

17. The in-ear headphone of claim 16, wherein the flexible finger extends in the direction toward the side of the shell from which the nozzle extends at an angle of between about 1° and about 5° from a vertical direction, when the in-ear headphone is in an initial position for insertion into the user's ear.

18. The in-ear headphone of claim 9, wherein the flexible finger extends from the proximal end portion to the distal end portion at an angle configured to be up and back relative to the user when the in-ear headphone is oriented for insertion into the user's ear.

19. The in-ear headphone of claim 9, wherein the flexible finger has a length sufficient to position the distal end portion of the flexible finger in an upper concha of the user's ear between a helix and an antihelix of the user's ear during use.

20. The in-ear headphone of claim 9, wherein the sound channel of the nozzle defines a nozzle axis, the nozzle axis being at an angle to a central axis of the audio driver.

21. The in-ear headphone of claim 20, wherein the angle between the nozzle axis and the central axis of the audio driver is between about 18° and about 30°.

22. The in-ear headphone of claim 9, further comprising an electrical cord extending from the shell for operable connection of the audio driver to an electronic device.

23. The in-ear headphone of claim 9, wherein the shell comprises a first shell portion and a second shell portion coupled to the first shell portion.

24. The in-ear headphone of claim 23, wherein the second shell portion comprises the nozzle.

* * * * *